US006670035B2

(12) United States Patent
Pittman et al.

(10) Patent No.: US 6,670,035 B2
(45) Date of Patent: Dec. 30, 2003

(54) BINDER FIBER AND NONWOVEN WEB

(75) Inventors: Ida L. J. Pittman, Jamestown, NC (US); Paul L Latten, Huntersville, NC (US); Tingdong Lin, Mooresville, NC (US)

(73) Assignee: Arteva North America S.A.R.L., Zurich (CH)

( * ) Notice: Subject to any disclaimer, the term of this patent is extended or adjusted under 35 U.S.C. 154(b) by 0 days.

(21) Appl. No.: 10/137,157

(22) Filed: May 2, 2002

(65) Prior Publication Data

US 2003/0194552 A1 Oct. 16, 2003

Related U.S. Application Data

(60) Provisional application No. 60/370,163, filed on Apr. 5, 2002.

(51) Int. Cl.[7] ..... D01F 8/00

(52) U.S. Cl. ..... 428/370; 428/373; 428/374

(58) Field of Search ..... 428/364, 370, 428/373, 374

(56) References Cited

U.S. PATENT DOCUMENTS

| | | | | |
|---|---|---|---|---|
| 4,950,541 A | | 8/1990 | Tabor et al. | |
| 5,126,201 A | | 6/1992 | Shiba et al. | |
| 5,272,236 A | * | 12/1993 | Lai et al. | 526/348.5 |
| 5,372,885 A | | 12/1994 | Tabor et al. | |
| 5,773,119 A | | 6/1998 | Wells | |
| 5,981,410 A | | 11/1999 | Hansen et al. | |
| 5,994,244 A | | 11/1999 | Fujiwara et al. | |
| 6,025,422 A | * | 2/2000 | Hall | 524/405 |
| 6,107,385 A | * | 8/2000 | Imahashi | 524/414 |
| 6,156,842 A | * | 12/2000 | Hoenig et al. | 525/171 |
| 6,190,768 B1 | * | 2/2001 | Turley et al. | 428/364 |
| 6,218,011 B1 | * | 4/2001 | Raetzsch et al. | 428/394 |
| 6,455,771 B1 | * | 9/2002 | Han et al. | 174/35 MS |
| 6,500,556 B1 | * | 12/2002 | Morris et al. | 428/463 |
| 6,537,473 B2 | * | 3/2003 | Raetzsch et al. | 264/103 |

FOREIGN PATENT DOCUMENTS

| | | |
|---|---|---|
| JP | 2-169718 | 6/1990 |

* cited by examiner

*Primary Examiner*—N. Edwards
(74) *Attorney, Agent, or Firm*—Gregory N. Clements

(57) ABSTRACT

The present invention comprises a binder fiber containing a metallocene catalyzed polyethylene (mPE) and an adhesion promoters. A web comprising the binder fiber and absorbent is also contemplated. The present invention also comprises a binder fiber containing polyolefin, an adhesion promoter, and an enhancement agent. The polyolefin may be polypropylene, high density polyethylene, medium density polyethylene, low density polyethylene, linear low density polyethylene, or ultra low density polyethylene, manufactured with either Ziegler-Natta or metallocene catalysts. A web comprising this binder fiber and absorbent is also contemplated. The adhesion promoter may be maleic anhydride grafted polyolefins, or ethylene-acrylic copolymers, or a combination of these. The enhancement agent may be one or more of titanium dioxide, talc, silica, alum, calcium carbonate, calcium oxide, and magnesium oxide.

9 Claims, 1 Drawing Sheet

BINDER FIBER AND NONWOVEN WEB

CROSS REFERENCE TO RELATED APPLICATION

This application claims the benefit of U.S. Provisional Application No. 60/370,163, filed Apr. 5, 2002.

BACKGROUND OF THE INVENTION

1. Field of the Invention

The present invention relates to a binder fiber which has improved adhesion with absorbent materials particularly at temperatures below about 140° C. The binder fibers can be in the form of low melting fibers or bicomponent fibers. Either of these fibers (or a mix of these fibers) can be used with absorbent material to create a nonwoven web. The improved binder fibers have improved adhesion at temperatures below 140° C. compared with current commercially available improved adhesion fibers. Such fibers enable the user to achieve the ideal thermal bonding at faster throughputs. Increase the z-directional web strength (thickness) for higher basis weight webs, and permit the incorporation of additional heat sensitive raw materials heretofore unusable, while retaining thermal bonding efficiency. Webs made from the binder fibers of the present invention are useful in diapers, incontinent pads, sanitary napkins and other absorbent pads for liquids.

2. Prior Art

Nonwoven webs particularly in the form of disposal absorbent articles such as disposable diapers have had much success in the marketplace. However, there is always a need to improve these products and particularly in terms of their adhesion such that they do not fall apart during manufacturing, processing into articles, and during use. Prior to the present invention, it was known to form nonwoven webs from wood pulp (and optionally up to 25% by weight super absorbent polymer, SAP), and a binder such as a bicomponent fiber or a low melting polymer fiber. These existing compositions contained approximately 10% binder and approximately 80 to 90% by weight wood pulp (and optionally SAP).

These nonwoven webs were first created by mixing the wood pulp (and optionally SAP) with the binder. This composition was then introduced into a heating zone, such that the lower melting material of the polymer, or the lower melting material of the bicomponent fiber would melt and coat at least a portion of most of the wood pulp fibers (and optionally SAP). The composition was then introduced into a cooling zone where the lower melting binder material would solidify thereby binding the wood pulp (and optionally SAP) into a unitary web structure.

Optionally, other fibers may be introduced such as other synthetic fibers or natural fibers to achieve other desired characteristics such as low density, high loft, compression resistance, and fluid uptake rate.

U.S. Pat. No. 4,950,541 and U.S. Pat. No. 5,372,885, both to Tabor, et al., hereby incorporated by reference, disclose the use of maleic acid or maleic anhydride grafted polyethylene. These fibers are the commercially available conventional fibers which the present invention improves or is an improvement thereover.

U.S. Pat. No. 5,981,410 to Hansen, et al. discloses bicomponent fibers blended with cellulose fibers such as pulp fibers or cotton fibers to create a nonwoven web useful in disposable diapers, for example.

U.S. Pat. No. 5,994,244 to Fujiwara, et al. discloses a nonwoven web comprised of cellulose type fibers such as fluff pulp and low melt fibers useful in producing disposable diapers, among other things. It also discloses the addition of inorganic particle (e.g. $TiO_2$) to the ethylene-acrylic ester-maleic anhydride sheath bicomponent spunbond filament. The particles reduce the adhesion of the filaments during spinning and give a more uniform web.

U.S. Pat. No. 5,126,201 to Shiba et al. discloses the addition of $TiO_2$ in both the core and sheath of bicomponent binder fibers to improve the cutting efficiency of nonwoven webs. The amount of $TiO_2$ in the core is >1.5%, preferably there is no $TiO_2$ in the sheath, since $TiO_2$ in the sheath reduces adhesion.

Japanese Patent JP 02-169718 to Matsuo et al. discloses polyolefin sheath/polyester core bicomponent fibers, the sheath containing 0.3–10% of inorganic particles (preferably $TiO_2$) to obtain a better softness and opacity of the web. This patent teaches that the addition of inorganic particles reduce the nonwoven web strength.

Despite the improvement that the Tabor patents give to nonwoven webs relative to improved adhesion strengths, there is still a need to improve the adhesion of nonwoven webs, and particularly, using lower processing temperatures. There is a need to increase the throughput or production without effecting thermal bonding efficiency. There is also a need to increase the z-directional web strength (the thickness) of thicker webs having higher weights. Lastly, there is a need in the art to retain thermal bonding efficiency but lower the processing temperature such that additional heat sensitive raw materials can be employed in the production of nonwoven webs, such as antimicrobials, deodorants, and fragrances.

SUMMARY OF THE INVENTION

The present invention is an improvement over existing nonwoven web products using the binding fibers disclosed in the Tabor, et al. references mentioned previously. In particular, the present invention improves the adhesion of nonwoven webs by using the binder fibers of the present invention. The binder fibers of the present invention have a lower thermal bonding temperature and therefore the throughput or production can be increased by maintaining the oven at its operating temperature and increasing the line speed of the webs through the oven. Alternatively, one could lower the processing temperature so that additional heat sensitive raw materials could be incorporated into the web without affecting the thermal bonding efficiency. Lastly, oven temperatures could be maintained and thicker webs could be produced by using the binder fibers of the present invention without slowing the production line speed, since the binder fibers of the present invention have a lower melting point than those commercially available.

The binder fibers of the present invention can either be in the form of low melt fiber, bicomponent fiber, or both. The low melt portion of the bicomponent fiber would comprise the same material as the low melt fiber. The low melt fiber and the low melt portion of the bicomponent fiber are made from polyolefin and are referred to as "base polyolefin". Base polyolefin does not include any polyolefin in the high melt component of bicomponent fiber. The preferred binder fiber of the present invention is the bicomponent fiber.

In the broadest sense, the present invention comprises a binder fiber containing a metallocene catalyzed polyethylene (mPE) and an adhesion promoter. The adhesion promoter may be maleic acid or maleic anhydride grafted polyolefins, or ethylene-acrylic copolymers, or a combination of these.

In the broadest sense, the present invention also comprises a binder fiber containing base polyolefin, an adhesion promoter, and an enhancement agent. The base polyolefin may be polypropylene, high density polyethylene, medium density polyethylene, low density polyethylene, linear low density polyethylene, or ultra low density polyethylene, manufactured with either Ziegler-Natta or metallocene catalysts. The adhesion promoter may be maleic anhydride grafted polyolefins, or ethylene-acrylic copolymers, or a combination of these. The enhancement agent may be one or more of titanium dioxide, talc, silica, alum, calcium carbonate, calcium oxide, and magnesium oxide.

In the broadest sense, the present invention also comprises a web made with the binder fibers of the present invention and absorbent.

DESCRIPTION OF THE PREFERRED EMBODIMENTS

Figure 1:
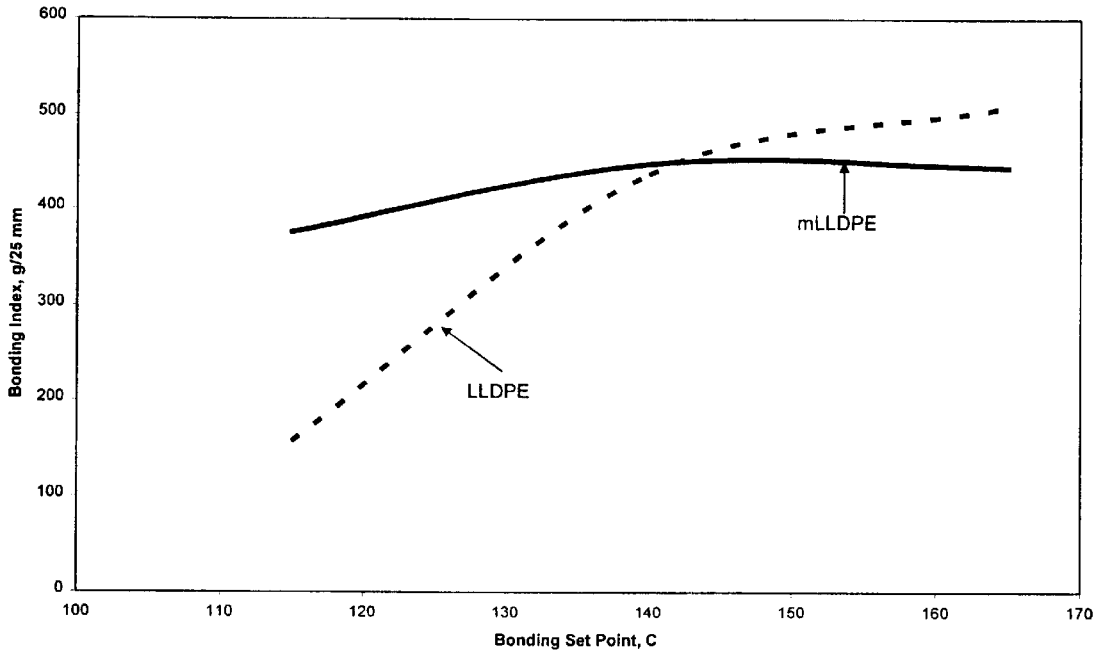
FIG. 1 compares the bonding index as a function of bonding temperature of the inventive binder fiber compared to prior art binder fiber.

Binder fibers of the present invention have a low melt portion which comprises either 100% of the binder fiber such that it is a low melting fiber, or a portion of the fiber is the low melt portion (such as bicomponent fibers). The low melt fiber and the low melt portion of the bicomponent fiber are made from polyolefin and are referred to as "base polyolefin". The low melt portion may consist of a metallocene catalyzed linear low-density polyethylene (mLLDPE) with an adhesion promoter.

The binder fibers of the present invention can also be base polyolefin with an adhesion promoter and an enhancement agent. Suitable base polyolefins may be high density polyethylene (HDPE), medium density polyethylene (MDPE), low density polyethylene (LDPE), linear low density polyethylene (LLDPE), ultra low density polyethylene (ULDPE), polypropylene (PP), or a mixture of these. These products are well known to those skilled in the art and are all commercially available from a wide variety of sources.

LLDPE resins are copolymers of ethylene and alpha-olefins with low alpha-olefin content. The higher the alpha-olefin content the lower the density of the resin. Metallocene catalyzed linear low density polyethylene (mLLDPE) are produced by Exxon Mobil under the trade name EXCEED and Dow Chemical under the trade name "AFFINITY". In contrast to LLDPE, produced with Ziegler-Natta catalysts, mLLDPE have a narrow molecular weight distribution and uniform composition distribution. Melting points of mLLDPE show a noticeable tendency on their composition and may very widely; for instance from 120° C. for copolymers containing 1½ mole % of alpha-olefin to 110° C. for copolymers containing 3.5 mole % alpha-olefin. In contrast, a LLDPE resin has a non-uniform compositional distribution. Melting such mixtures is dominated by the low branched fraction which is quite crystalline. As a result the melting points of LLDPE resins are not sensitive to copolymer composition and usually fall in the range of 125 to 128° C.

The adhesion promoters suitable for the present invention may be polyolefins grafted with maleic acid or maleic anhydride (MAH), both of which convert to succinic acid, succinic anhydride upon grafting to the polyolefin. The preferred incorporated MAH graft level is 10% by weight (by titration). Also, ethylene-acrylic copolymers, and a combination of this with the grafted polyolefins mentioned are suitable adhesion promoters. Commercially available maleic anhydride grafted polyethylenes are known as ASPUN resins from Dow Chemical. Commercially available ethylene-acrylic copolymers are Bynel 2022, Bynel 21E533 and Fusabond MC 190D or Fusabond C, both from DuPont, and the Escor acid terpolymers from ExxonMobil. The ethylene-acrylic copolymer comprises from about 1 to about 20% by weight based on the weight of the base polyolefin, and preferably from 5 to 15% by weight. The amount of grafted polyolefin adhesion promoter is such that the weight of incorporated maleic acid or maleic anhydride comprises from about 0.05% to about 2% by weight, and preferably from 0.1 to 1.5%.

The enhancement agent can comprise any of titanium dioxide, talc, silica, alum, calcium carbonate, calcium oxide, magnesium and other oxides; titanium dioxide being preferred. The enhancement agent is employed in the polymer in an amount from about 0.1 to about 1% based on the weight of the base polyolefin. The particle size, in order to achieve good dispersion within the polymer and good spinnability is in the range of about 0.04 to about 5 microns, and preferably in the range of 0.05 to 2 micron.

Once the base polyolefin with adhesion promoter and any enhancement agent is produced, preferably by blending master batches to the base polyolefin, it is melt spun into fiber as in known in the art. When a bicomponent fiber is employed as the binder fiber, the high melt portion may be selected from the class of polyolefins, such as polyethylene, polypropylene, and polybutylene; polyesters such as polyethylene terephthalate (PET), polybutylene terephthalate, polyethylene naphthalate, and the like; polyamides such as nylon 6, nylon 66; polyacrylates such as polymethacrylate, polymethylmethacrylate, and the like; as well as mixtures and copolymers thereof. Although the bicomponent fiber can be the side-by-side type or the sheath-core type, the sheath-core type is preferred, particularly where the low melt component is the sheath. The low melt portion of the bicomponent fiber can comprise from about 5% to about 75% by weight of said bicomponent fiber. Bicomponent fibers have an average length of from about 3 to 75 mm. Bicomponent fibers having a denier of between 1 and 10 are the preferred binder component.

Ignoring other components for a moment, suitable bicomponent fibers are polyethylene/polypropylene; polyethylene/polyester (especially polyethylene terephthalate); polyethylene/nylon, for example, as well as mixtures of these. Preferably polyethylene/polyester fibers, such as mLLDPE/PET or polyethylene/polypropylene, such as mLLDPE/PP are used. When both the low melt portion and the high melt portion of the bicomponent fiber contains polyolefins, the high melt polyolefin must have a melting point at least 5° C. higher than the low melt polyolefin.

Suitable absorbents are natural or synthetic absorbents. Synthetic absorbents are primarily known as super absorbent polymers (SAP). The absorbents comprise 50–95% by weight of the web. Natural absorbents are hydrophilic materials such as cellulosic fibers, wood pulp fluff, cotton, cotton linters, and regenerated cellulose fibers such as rayon, or a mixture of these. Preferred is wood pulp fluff, which is both inexpensive and readily available.

Absorbents do not absorb as much bodily fluid as when a portion of them has been replaced with synthetic fibers, and preferably polyester fibers, which provide loft to the composite. Providing loft to the composite exposes more surface area of the natural absorbents to the bodily fluids and thus they are much more efficient in absorbing the bodily fluid.

Absorbent pads employing natural absorbents may not provide adequate fluid intake for all circumstances. Also natural absorbents are very bulky. Accordingly, many absorbent pads employ SAP in relatively low quantities. This is because the cost of SAP is much higher than the cost of natural absorbents. Replacing some of the natural absorbents with SAP can reduce the overall bulk of the pad and/or provide superior fluid intake.

As used herein, the term "super absorbent polymer" or "SAP" refers to a water-swellable, generally water-insoluble material capable of absorbing at least about 10, desirably about 20, and preferably about 50 times or more its weight in water. The super absorbent polymer may be formed from organic material, which may include natural materials such as agar, pectin, and guar gum, as well as synthetic materials such as synthetic hydrogel polymers. Synthetic hydrogel polymers include, for example, carboxymethyl cellulose, alkali metal salts of polyacrylic acid, polyacrylamides, polyvinyl alcohol, ethylene maleic anhydride copolymers, polyvinyl ethers, hydroxypropyl cellulose, polyvinyl morpholinone, polymers and copolymers of vinyl sulfonic acid, polyacrylates, polyacrylamides, polyvinyl pyridine, and the like. Other suitable polymers include hydrolyzed acrylonitrile grafted starch, acrylic acid grafted starch, and isobutylene maleic anhydride copolymers and mixtures thereof. The hydrogel polymers are preferably lightly crosslinked to render the materials substantially water insoluble. Crosslinking may, for example, be by irradiation or covalent, ionic, van der Waals, or hydrogen bonding. Suitable materials are available from various commercial vendors such as the Dow Chemical Company, Allied Colloid, Inc., and Stockhausen, Inc. The super absorbent polymer may be in the form of particles, flakes, fibers, rods, films or any of a number of geometric forms.

Webs of the present invention can be made from either the dry laid or wet laid process. Dry laid webs are made by the airlay, carding, garneting, or random carding processes. Air laid webs are created by introducing the fibers into an air current, which uniformly mixes the fibers and then deposits them on a screen surface. The carding process separates tufts into individual fibers by combing or raking the fibers into a parallel alignment. Garneting is similar to carding in that the fibers are combed. Thereafter the combed fibers are interlocked to form a web. Multiple webs can be overlapped to build up a desired weight. Random carding uses centrifugal force to throw fibers into a web with random orientation of the fibers. Again multilayers can be created to obtain the desired web weight. Wet laid webs are made by a modified papermaking process in which the fibers are suspended in water, decanted on a screen, dried and bonded together.

The web of fibers can be bonded by thermal means. Thermal bonding utilizes an oven (hot air, radiant or microwave), or heated calendar roll(s), or ultrasonic energy. The web now has sufficient rigid structure to be useful as a component of an absorbent pad.

The absorbent is mixed with the binder fiber (base polyolefin, adhesion promoter, and enhancement agent) such that the binder fiber comprises from about 5 to about 25 percent of the total web, with the remainder being substantially the absorbent. The web compositions of the present invention can be layered until their weight is in the range from about 20 to about 500 grams per square meter (gsm), preferably from about 50 to about 250 gsm.

When a binder fiber or a suitable bicomponent fiber is employed in a mixture with the absorbent, an oven operating at a temperature sufficient to melt the low melt polymer fiber or the low melt portion of the bicomponent fiber must be employed. The web is then subjected to cooling conditions such that the binder fiber solidifies thus structurally locking the absorbent fibers to one another. Thereafter, the web may be cut into various lengths and widths for end use applications, namely, fenestration drapes, dental bibs, eye pads, diapers, incontinent pads, sanitary napkins, wound dressing pads, air filters, liquid filters and fabrics such as drapes, bedding or pillows.

TEST PROCEDURE

The melt point of the polymers tested hereunder is in accordance with the procedure of ASTM D3418-97, in a helium atmosphere.

The wet and dry strength of the web was measured according to TAPPI test methods T 456 om-87 and T 494 om-88 respectively. The wet strength was measured after an immersion time of 15 sec. The web strength was tested on a 25.4×203.2 millimeter strip for both the MD (machine direction) and CD (cross direction) with an Instron 1122 test machine. The tests were run at 127 mm original separation at a speed of 304.8 mm per minute. The strength is reported in units of g/25 mm.

Bonding Index is the square root of the product of the machine direction and cross direction strengths.

EXAMPLES

In the following examples various bicomponent fibers were made with a core of 0.55 IV polyethylene terephthalate and a sheath of various compositions. The bicomponent fibers comprised a 50/50 core/sheath with the sheath being either LLDPE or mLLDPE. The LLDPE was obtained from Dow Chemical Company as ASPUN XU-61800.34 (Dow 34), and the mLLDPE was obtained from Dow Chemical Company as XU-58200.03 (Dow 03). The Dow 03 had a melting point of 108° C. and the Dow 34 had a melting point of 128° C. Additives in a master batch were blended with the sheath polymer prior to fiber spinning. The bicomponent fibers, after being spun and drawn, were cut into 6 mm lengths.

EXAMPLE 1

Various 2.5 dpf bicomponent fibers were made as shown in Table 1. The adhesion promoter was maleic anhydride (MAH) grafted polyethylene was obtained from Dow Chemical as ASPUN XU 60769.07 (Dow 07) added at the 10% level to give an incorporated MAH concentration of 0.1% in the sheath.

Nonwoven webs were made from these bicomponent fibers with a wet-lay process to give a basis weight of 90 g/m$^2$. The webs comprised 20% bicomponent fiber by weight and 80% wood pulp. The pulp type employed was Waco 416.

The web samples were bonded in a hot air oven at 143 or 166° C. for 30 seconds. The bonding indices are shown in Table 1.

TABLE 1

| Sheath | Bonding Temperature (° C.) | Bonding Index (g/25 mm) |
|---|---|---|
| LLDPE | 143 | 560 |
| mLLDPE | 143 | 962 |

TABLE 1-continued

| Sheath | Bonding Temperature (° C.) | Bonding Index (g/25 mm) |
|---|---|---|
| LLDPE | 166 | 707 |
| mLLDPE | 166 | 902 |

This illustrates that mLLDPE binder fibers, with an adhesion promoter, have higher web strengths than the prior art LLDPE sheath bicomponent fibers.

EXAMPLE 2

2 dpf fibers were prepared as in Example 1. Webs were prepared containing 10% bicomponent fibers with a basis weight of 100 gsm. The webs were bonded for 30 seconds at dryer temperatures of 115, 140 and 165° C. The results are set forth in Table 2.

TABLE 2

| Sheath | Bonding Temperature (° C.) | Bonding Index (g/25 mm) |
|---|---|---|
| LLDPE | 115 | 157 |
| mLLDPE | 115 | 376 |
| LLDPE | 140 | 437 |
| mLLDPE | 140 | 448 |
| LLDPE | 165 | 508 |
| mLLDPE | 165 | 444 |

This data is graphed in FIG. 1, and illustrates the broad bonding window with mLLDPE compared to the prior art LLDPE.

EXAMPLE 3

The mLLDPE bicomponent fibers of Example 2 were formed into a web using an air laid process. The web contained 12% bicomponent fibers and has a basis weight of 250 gsm. Thermo-tapes were placed on the top and bottom of the web. These indicated the actual web temperature that the top and bottom of the web had experienced in the bonding oven. Bonding set temperatures of 145 and 165° C. were used. The difference in the actual web temperatures from the set temperature is given in Table 3.

TABLE 3

| Bonding temperature (° C.) | Top temperature (° C.) | Bottom temperature (° C.) |
|---|---|---|
| 145 | −9 | −17 |
| 165 | −9 | −29 |

This illustrates the value of a binder fiber that has both a lower and broader bonding window (see FIG. 1). The full thickness of the web is fully bonded by the use of a binder fiber with a broad bonding window, such as mLLDPE fibers with an adhesion promoter, giving optimum z-directional strength at low bonding temperatures.

EXAMPLE 4

The mLLDPE bicomponent fibers of Example 2 were formed into a web using an air laid process. The web contained 12% bicomponent fibers and has a basis weight of 175 gsm. In addition a bicomponent fiber was prepared without an adhesion promoter, only the mLLDPE sheath. The webs were bonded with a set temperature of 155° C. for 17 seconds. The bonding indices are set forth in Table 4.

TABLE 4

| Sheath | Bonding Index, dry (g/25 mm) | Bonding Index, wet (g/25 mm) |
|---|---|---|
| mLLDPE | 217 | 171 |
| mLLDPE + 0.1% MAH | 1493 | 789 |
| LLDPE + 0.1% MAH | 816 | 350 |

This shows the need for an adhesion promoter and the superior bonding index of mLLDPE binder fibers containing an adhesion promoter compared to prior art.

EXAMPLE 5

Bicomponent fibers, 2 dpf, were prepared containing 0.7% $TiO_2$ in the 50% sheath and compared to LLDPE fibers not containing an enhancing agent. All sheaths contained 0.1 weight % incorporated MAH. These bicomponent fibers were formed into an 85 gsm web using a wet laid process at the 20% level, bonded with an oven set point of 150° C. for 50 seconds. The bonding indices of these webs are set forth in Table 5.

TABLE 5

| Sheath | Bonding Index (g/25 mm) |
|---|---|
| LLDPE | 972 |
| LLDPE + $TiO_2$ | 1966 |
| mLLDPE + $TiO_2$ | 2070 |

This illustrates the surprising increase in bonding index for both LLDPE and mLLDPE binder fibers (containing an adhesion promoter) with the addition of an inorganic particle enhancing agent such as $TiO_2$.

While not wishing to be bound by any theory, it is believed that the presence of small inorganic particles on the surface of the binder fiber improves the dispersion of the fibers during the web formation process. This yields a more uniform distribution of fibers through the web and a higher bonding index.

Thus it is apparent that there has been provided, in accordance with the invention, a binder fiber containing a metallocene catalyzed polyethylene (mPE) and an adhesion promoter; and a web made therefrom; binder fiber containing polyethylene, an adhesion promoter, and an enhancement agent; and a web made therefrom, that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A bicomponent fiber comprising a high melt portion and a low melt portion, wherein said low melt portion is a polyolefin, an adhesion promoter, and an enhancement agent, and wherein said high melt portion is polyester or polyacrylate, or a combination of these.

2. The bicomponent fiber of claim 1, wherein said base polyolefin is selected from the class of polypropylene, high density polyethylene (HDPE), medium density polyethylene (MDPE), low density polyethylene (LDPE), linear low density polyethylene (LLDPE), and ultra low density polyethylene (ULDPE).

3. The bicomponent fiber of claim 1, wherein said base polyolefin is metallocene catalyzed polyolefin.

4. The bicomponent fiber of claim 1, wherein said enhancement agent is selected from the class of titanium dioxide, talc, silica, alum, calcium carbonate, calcium oxide, and magnesium oxide.

5. The bicomponent fiber of claim 1, wherein said adhesion promoter is selected from the class of maleic acid or maleic anhydride grafted polyolefin, ethylene-acrylic copolymers, or a combination of these.

6. The bicomponent fiber of claim 5, wherein said grafted polyolefin contains incorporated maleic acid or maleic anhydride in the range from about 0.05 to about 2.0 weight % of said base polyolefin, and from about 0.1 to about 1 weight % of said enhancement agent based on said base polyolefin.

7. The bicomponent fiber of claim 5, wherein said base polyolefin contains about 1 to about 20 weight % of said ethylene-acrylic copolymers, and from about 0.1 to about 1 weight % of said enhancement agent, both based on said weight of said base polyolefin.

8. The bicomponent fiber of claim 1, wherein said high melting portion comprises polyester.

9. The bicomponent fiber of claim 1, wherein said high melting portion comprises polyacrylate.

* * * * *